US009471017B2

(12) United States Patent
Tanaka et al.

(10) Patent No.: US 9,471,017 B2
(45) Date of Patent: Oct. 18, 2016

(54) IMAGE FORMING APPARATUS FOR AUTOMATICALLY RELEASING PRESSURE APPLIED TO A FIXING NIP PORTION

(71) Applicant: CANON KABUSHIKI KAISHA, Tokyo (JP)

(72) Inventors: Masaki Tanaka, Kawasaki (JP); Tomoya Tateishi, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/887,097

(22) Filed: Oct. 19, 2015

(65) Prior Publication Data

US 2016/0116874 A1 Apr. 28, 2016

(30) Foreign Application Priority Data

Oct. 22, 2014 (JP) ..... 2014-215796

(51) Int. Cl.
*G03G 15/20* (2006.01)
*G03G 21/16* (2006.01)

(52) U.S. Cl.
CPC ..... *G03G 15/2053* (2013.01); *G03G 15/2032* (2013.01); *G03G 21/1685* (2013.01)

(58) Field of Classification Search
CPC ..... G03G 15/2032; G03G 15/2035; G03G 21/1685; G03G 2221/1639; G03G 15/2053
USPC ..... 399/122, 124, 21
See application file for complete search history.

(56) References Cited

U.S. PATENT DOCUMENTS

| | | | | |
|---|---|---|---|---|
| 8,326,197 | B2 * | 12/2012 | Kim | G03G 15/2032 399/122 |
| 2009/0060571 | A1 * | 3/2009 | Kang | G03G 21/1685 399/122 |
| 2010/0046995 | A1 * | 2/2010 | Nakamura | G03G 15/2032 399/328 |
| 2012/0057901 | A1 * | 3/2012 | Oba | G03G 15/2032 399/122 |
| 2014/0153965 | A1 * | 6/2014 | Nanno | G03G 21/1685 399/122 |
| 2014/0348542 | A1 * | 11/2014 | Yoshida | G03G 21/1685 399/122 |

FOREIGN PATENT DOCUMENTS

JP 5511598 B2 6/2014

* cited by examiner

*Primary Examiner* — Sophia S Chen
(74) *Attorney, Agent, or Firm* — Canon U.S.A. Inc., IP Division

(57) ABSTRACT

An image forming apparatus according to the present invention can switch a fixing nip portion between a pressurized state and a pressure released state by rotating a cam via a first engagement portion provided in a fixing unit, and a second engagement portion provided in a main body of the image forming apparatus, in which a difference between a phase of the cam in the pressurized state and a phase of the cam in the pressure released state is 180°, and the first engagement portion and the second engagement portion engage with each other when the fixing unit is mounted on the main body regardless of whether the fixing nip portion is in the pressurized state or the pressure released state.

15 Claims, 8 Drawing Sheets

IMAGE FORMING APPARATUS FOR AUTOMATICALLY RELEASING PRESSURE APPLIED TO A FIXING NIP PORTION

BACKGROUND OF THE INVENTION

1. Field of the Invention

The present invention relates to an image forming apparatus for forming an image on a recording material.

2. Description of the Related Art

There is an image forming apparatus including a pressure releasing mechanism for automatically releasing pressure applied to a fixing nip portion to improve jam processability in a fixing unit of the image forming apparatus or to prevent deformation of a component. If the fixing unit is removable from a main body of the image forming apparatus, the pressure releasing mechanism is provided in the fixing unit, and a power source for driving the pressure releasing mechanism is provided in the main body of the image forming apparatus.

After the fixing unit is removed from the main body of the image forming apparatus, a pressure release cam in the pressure releasing mechanism in the fixing unit may move due to application of a shock to the fixing unit, for example. Consequently, a phase of the pressure release cam and a phase of a coupling provided in the main body of the image forming apparatus for transmitting power to the pressure release cam do not match each other. Therefore, the fixing unit cannot be mounted on the main body of the image forming apparatus.

As a countermeasure, Japanese Patent No. 5511598 discusses a configuration in which even if a phase of a pressure release cam and a phase of a coupling in a main body of an image forming apparatus do not match each other, the phase of the pressure release cam is made to match the phase of the coupling in synchronization with an operation for mounting a fixing unit on the image forming apparatus.

However, in this configuration, the fixing unit requires a shape for moving the pressure release cam in contact with the coupling in the main body of the image forming apparatus. To move the pressure release cam by an operation for mounting the fixing unit on the main body of the image forming apparatus, a large force is required when the fixing unit is mounted.

SUMMARY OF THE INVENTION

The present invention is directed to an image forming apparatus capable of easily mounting a fixing unit on a main body of an image forming apparatus regardless of whether a phase of a pressure release cam in the fixing unit is in a pressurized state or a pressure released state in a configuration in which the fixing unit is mountable on and removable from the main body of the image forming apparatus.

According to an aspect of the present invention, an image forming apparatus includes a main body of the image forming apparatus, a fixing unit configured to fix an unfixed image on a recording material to the recording material while conveying the recording material with the recording material nipped in a fixing nip portion, the fixing unit being removably mounted on the main body and including a cam for switching pressure applied to the fixing nip portion and a first engagement portion for transmitting a driving force to the cam, and a second engagement portion provided in the main body so as to engage with the first engagement portion in a state where the fixing unit is mounted on the main body, wherein the image forming apparatus can switch the fixing nip portion between a pressurized state and a pressure released state by rotating the cam via the first engagement portion and the second engagement portion, wherein a difference between a phase of the cam in the pressurized state and a phase of the cam in the pressure released state is 180°, and wherein the first engagement portion and the second engagement portion engage with each other when the fixing unit is mounted on the main body regardless of whether the fixing nip portion is in the pressurized state or the pressure released state.

Further features of the present invention will become apparent from the following description of exemplary embodiments with reference to the attached drawings.

DESCRIPTION OF THE EMBODIMENTS

Figure 1:
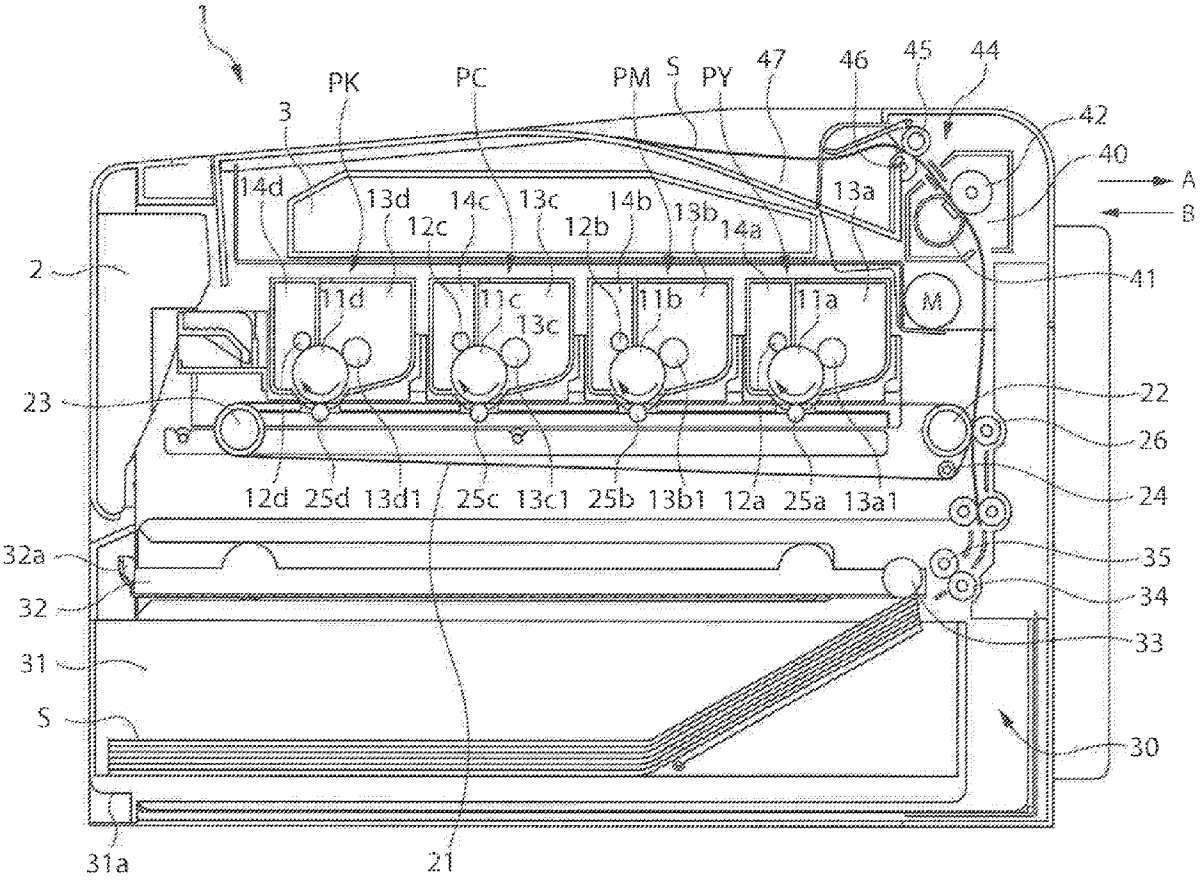
FIG. 1 is a cross-sectional view of an image forming apparatus.

FIG. 1 is a cross-sectional view of an image forming apparatus 1. The image forming apparatus 1 is a tandem type four full color laser printer. As illustrated in FIG. 1, four process cartridges PY, PM, PC, and PK are removably mounted on the image forming apparatus 1. The process cartridges PY, PM, PC, and PK respectively include photosensitive drums 11*a*, 11*b*, 11*c*, and 11*d* and charging rollers 12*a*, 12*b*, 12*c*, and 12*d* for uniformly charging surfaces of the photosensitive drums. Further, the process cartridges PY, PM, PC, and PK also respectively include development devices 13*a*, 13*b*, 13*c*, and 13*d* that develop electrostatic latent images formed on the photosensitive drums. The development devices 13*a*, 13*b*, 13*c*, and 13*d* respectively include development rollers 13*a* 1, 13*b* 1, 13*c* 1, and 13*d* 1 and toners. Further, the development devices 13*a*, 13*b*, 13*c*, and 13*d* respectively include cleaning devices 14*a*, 14*b*, 14*c*, and 14*d* that remove the toners remaining on the surfaces of the photosensitive drums.

A laser scanner unit 3 is provided above an area where the cartridges PY, PM, PC, and PK are arranged. The laser scanner unit 3 outputs a laser beam depending on input image information, and scans and exposes the surface of each of the photosensitive drums 11*a*, 11*b*, 11*c*, and 11*d*. Thus, an electrostatic latent image is formed on each of the photosensitive drums.

A belt unit including a drive roller 22, a turn roller 23, a tension roller 24, and an intermediate transfer belt 21 is provided below the area where the cartridges PY, PM, PC, and PK are arranged. Inside the intermediate transfer belt 21, four primary transfer rollers 25*a*, 25*b*, 25*c*, and 25*d* respectively opposing the photosensitive drums 11*a*, 11*b*, 11*c*, and 11*d* are provided via the belt 21. A secondary transfer roller 26 is provided to oppose the drive roller 22 via the belt 21.

The cartridges PY, PM, PC, and PK and the belt unit can be taken out by opening a door 2 in a main body of the image forming apparatus 1.

A sheet feeding unit 30 that feeds sheets S such as paper serving as a recording material is provided below the intermediate transfer belt 21. The sheet feeding unit includes a sheet cassette 31 in which the sheets S before image formation are stored, and a conveyance path 32 through which the sheet S manually fed is conveyed. The sheet feeding unit 30 includes a feeding roller 33 for feeding the sheet S, a separation roller 34 for separating the sheets S one by one, and a conveyance roller 35 for conveying the sheet S toward the downstream side. A handle 31*a* is used to pull out the sheet cassette 31, and a handle 32*a* is used to pull out the conveyance path 32.

The sheet S on which a toner image has been transferred at a transfer portion is conveyed to a fixing unit 40. The sheet S on which the toner image has been fixed by the fixing unit 40 is conveyed by a discharge roller pair 44 including a discharge roller 45 and an idler roller 46, and is discharged onto a tray 47.

The fixing unit 40 will be described below with reference to FIGS. 2A to 8B. The fixing unit 40 is removable in a direction indicated by an arrow A illustrated in FIG. 1 from the main body of the image forming apparatus 1. A direction indicated by an arrow B indicates a direction in which the fixing unit 40 is mounted.

Figure 2A:
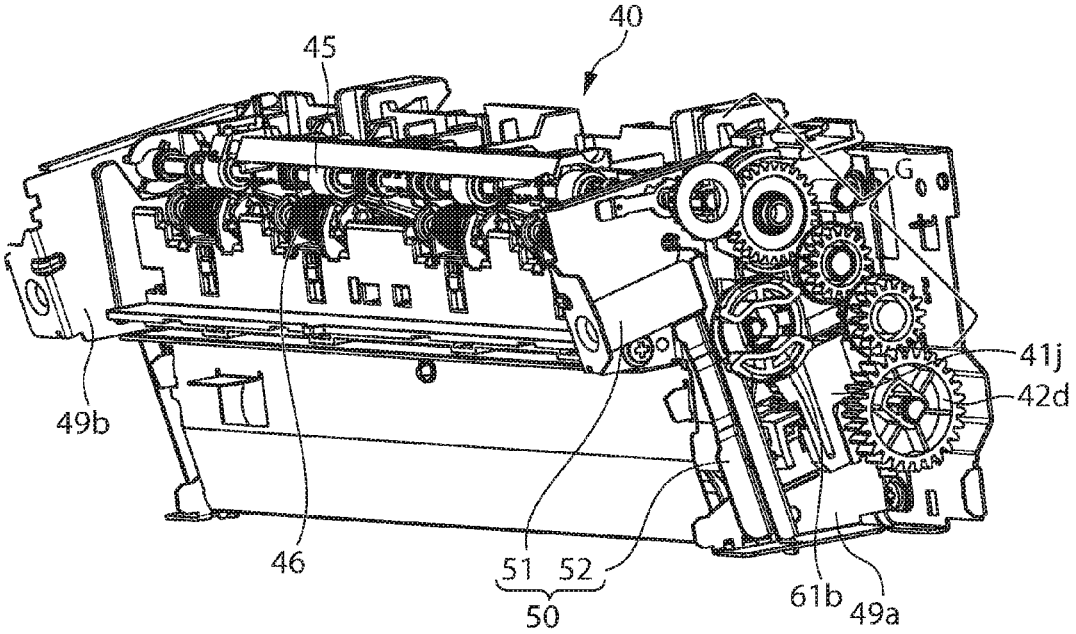
FIGS. 2A and 2B are a perspective view and a cross-sectional view of a fixing unit, respectively.
Figure 2B:
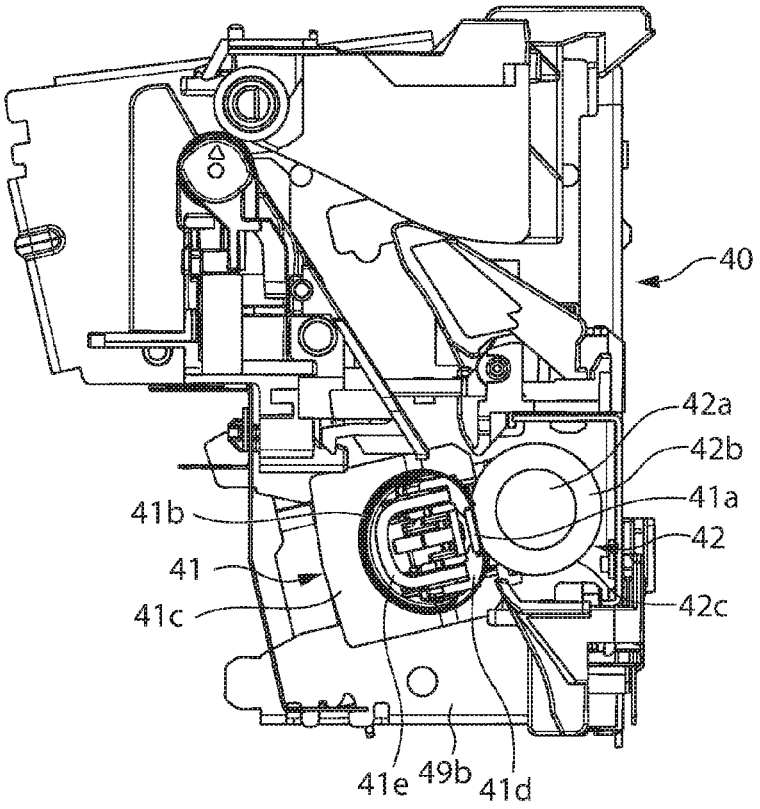

FIGS. 2A and 2B are respectively a perspective view and a cross-sectional view of the fixing unit 40. The fixing unit 40 includes a heating unit 41 and a pressurizing roller 42. A fixing nip portion for fixing the toner image while conveying the sheet S with the sheet S nipped therein is formed between the heating unit 41 and the pressurizing roller 42.

The heating unit 41 is slidably held in a direction in which the pressurizing roller 42 is compressed by respective grooves provided in metal frames 49*a* and 49*b* in the fixing unit 40. The heating unit 41 includes a heater 41*a* that generates heat with electric power fed via a power feeding connector 41*j* and cylindrical heating films 41*b* that rotates while sliding relative to the heater 41*a* as the pressurizing roller 42 rotates. The heater 41*a* contacts an inner surface of the heating film 41*b*. The heater 41*a* is a plate-shaped ceramic heater in which a heat generation resistor is formed on a ceramic substrate. The heating unit 41 includes a guide member 41*c* having a flange portion for regulating movement toward a generatrix direction of the heating film 41*b* and a heater holder 41*d* made of heat-resistant resin for holding the heater 41*a*. A metal stay 41*e* reinforces the heater holder 41*d* along a longitudinal direction of the heater holder 41*d* (a direction parallel to the generatrix direction of the heating film 41*b*). The heating unit 41 is urged toward the pressurizing roller 42 by a pressure application portion 50, described below, and a fixing nip portion is formed with the urging force thereby. The fixing nip portion includes the heater 41*a* and the pressurizing roller 42 via the heating film 41*b*, and the sheet S passes between the heating film 41*b* and the pressurizing roller 42.

The pressurizing roller 42 includes a core metal 42*a*, a silicone rubber layer 42*b*, and a fluorine resin surface layer 42*c*. The pressurizing roller 42 is rotatably supported on the frames 49*a* and 49*b* via bearings. A gear 42*d* is provided at an end of the core metal 42*a* in the pressurizing roller 42, and rotates with power of the motor M provided in the main body of the image forming apparatus 1.

Figure 3A:
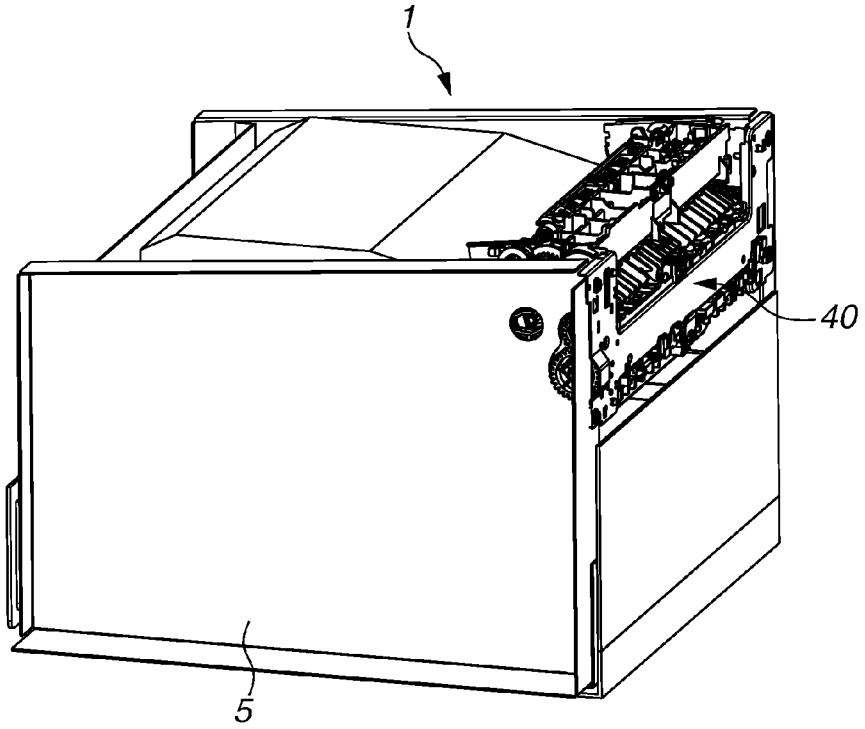
FIGS. 3A and 3B illustrate a state where the fixing unit is mounted and removed, respectively.
Figure 3B:
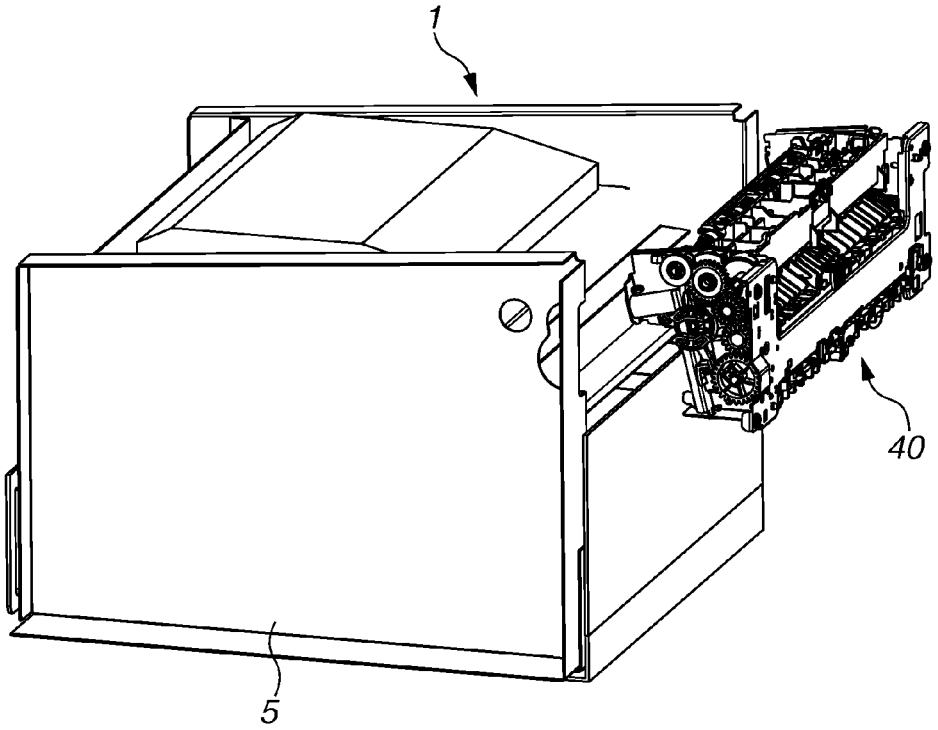

The fixing unit 40 is configured to be mountable on and removable from the main body of the image forming apparatus 1. As illustrated in FIGS. 3A and 3B, the fixing unit 40 can be removed from the main body of the image forming apparatus 1 (FIG. 3B) when moved parallel in a direction toward the right in FIG. 3A (corresponding to the A direction illustrated in FIG. 1) after removing a fixing screw for fixing the fixing unit 40 to a main body frame 5 in the main body of the image forming apparatus 1. When the fixing unit 40 is mounted on the main body of the image forming apparatus 1, the fixing unit 40 is mounted on the main body frame 5, and is then fixed to the main body frame 5 with the fixing screw.

The fixing unit 40 includes a pressure application portion 50 for applying pressure to the fixing nip portion for conveying a recording material having an unfixed image formed thereon with the recording material nipped therein, and a pressure release cam for releasing the pressure applied to the fixing nip portion by acting on the pressure application portion, and is configured to be mountable on and removable from the main body of the image forming apparatus 1. The main body of the image forming apparatus 1 includes a coupling portion that engages with the pressure release cam in the fixing unit 40 and transmits a driving force to the pressure release cam. The pressure release cam in the fixing unit 40, which remains mounted on the main body of the image forming apparatus 1, is rotated via the coupling portion so that the fixing nip portion can be switched to a pressurized state and a pressure released state.

The pressure application portion 50 will be described below mainly with reference to FIG. 2A. The pressure application portion 50 is provided at each of both ends of the fixing unit 40 in an axial direction of the pressurizing roller 42. The pressure application portion 50 includes a pressurizing plate 52 and a compression spring 51 for urging the pressurizing plate 52. The force of the compression spring 51 is transmitted to the pressurizing plate 52, the stay 41*e*, the heater holder 41*d*, and the heater 41*a*. The compression spring 51 applies a force in a direction toward the pressurizing roller 42 to the heating unit 41 so that the fixing nip portion is formed therebetween.

Figure 4:
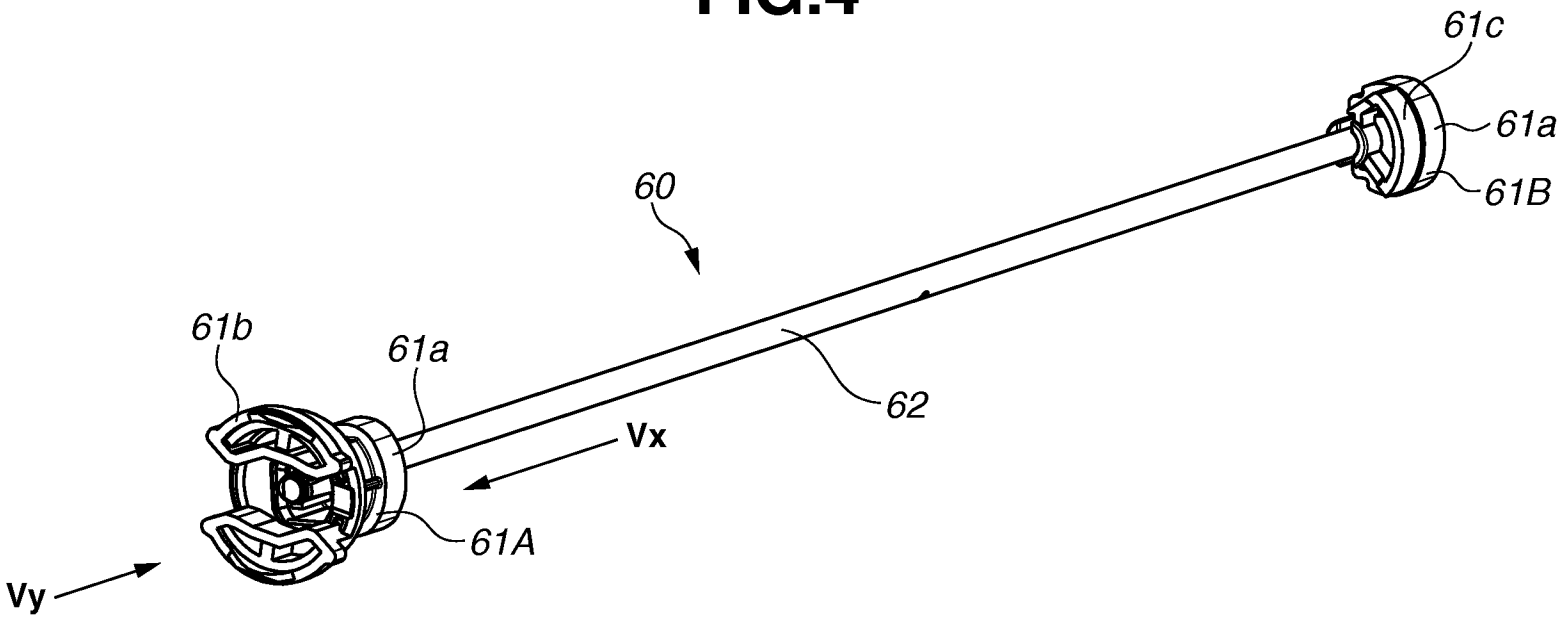
FIG. 4 is a perspective view of a pressure releasing mechanism in the fixing unit.
Figure 5A:
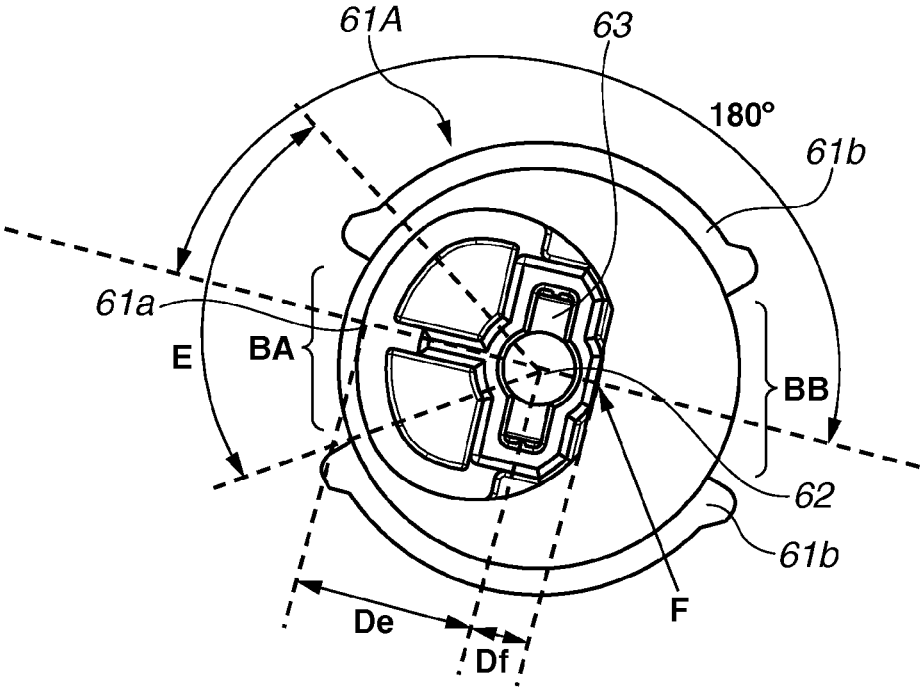
FIGS. 5A and 5B illustrate a pressure release cam.
Figure 5B:
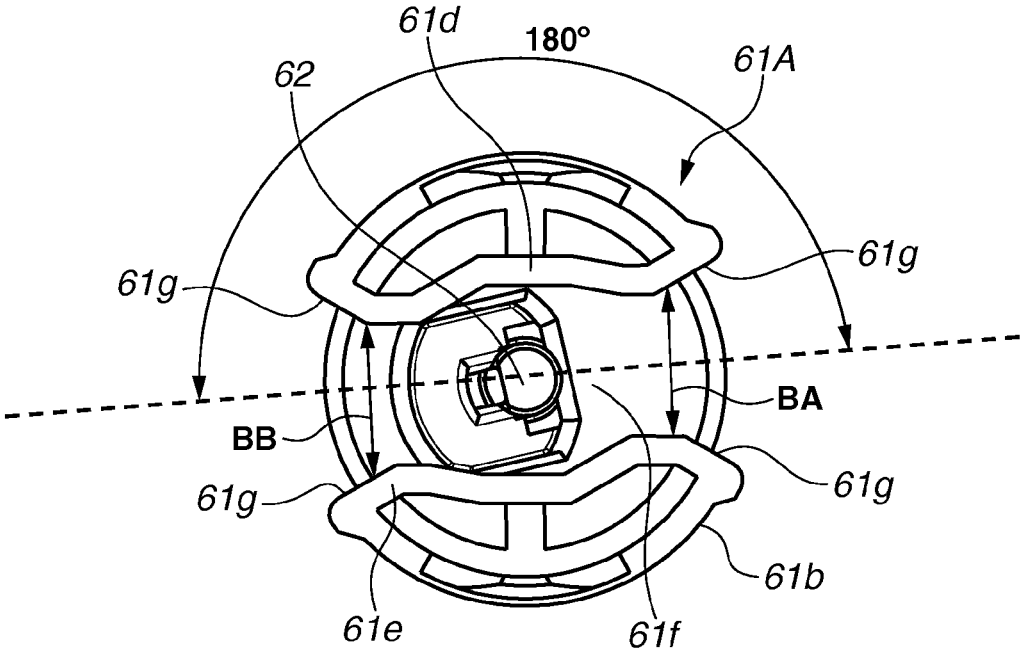

A pressure releasing mechanism 60 provided in the fixing unit 40 will be described below with reference to FIG. 2A and FIGS. 4 to 8B. As illustrated in FIG. 4, the pressure releasing mechanism 60 includes a rotation shaft 62 and pressure release cams 61A and 61B respectively fixed to both ends of the rotation shaft 62. The pressure release cam 61A is provided with an engagement portion (first engagement portion) 61*b* that engages with a "coupling 70 provided in the main body of the image forming apparatus 1 for transmitting power to the pressure release cams 61A and 61B". The rotation shaft 62 is rotatably fitted in the frames 49*a* and 49*b*. FIG. 5A illustrates the pressure release cam 61A viewed in a Vx direction illustrated in FIG. 4, and FIG. 5B illustrates the pressure release cam 61A viewed in a Vy direction illustrated in FIG. 4. The pressure release cam 61A and the rotation shaft 62 are fastened to each other in a rotational direction by a parallel pin 63 illustrated in FIG. 5A, to rotate together. Similar to the pressure release cam 61A, the pressure release cam 61B is fastened to the rotation shaft 62 by a parallel pin (not illustrated). The pressure release cams 61A and 61B are respectively provided with cam portions 61*a* for pushing up the pressurizing plate 52. An area F of a minimum outer diameter part, with a distance Df from the center in a radial direction of the rotation shaft 62, in the cam portion 61*a* is substantially a point. An area E of a maximum outer diameter part, with a distance De from the center of the rotation shaft 62, in the cam portion 61*a* is provided at a position spaced a phase difference 180° apart from the area F of the minimum outer diameter part.

The center of the area E is a position spaced a phase difference of just 180° apart from the area F. The area F is used when the fixing nip portion is brought into the pressurized state, and the area E is used when the fixing nip portion is brought into the pressure released state. More specifically, a difference between a phase of the pressure release cam in the pressurized state and a phase of the pressure release cam in the pressure released state is set to 180°. The two pressure release cams 61A and 61B provided at both ends of the rotation shaft 62 are fixed to the rotation shaft 62 so that respective profiles of cam portions 61*a* are the same and their respective phases become the same.

Figure 7:
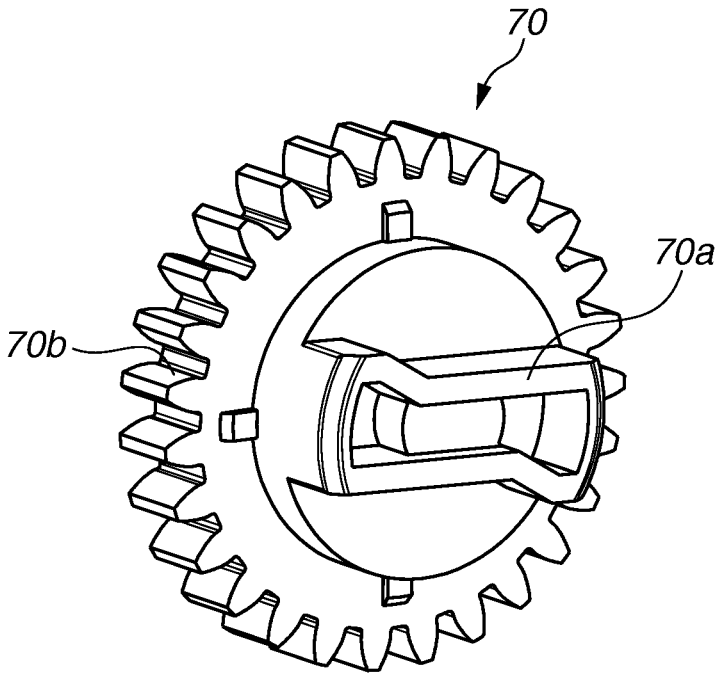
FIG. 7 is a perspective view of a coupling.
Figure 8A:
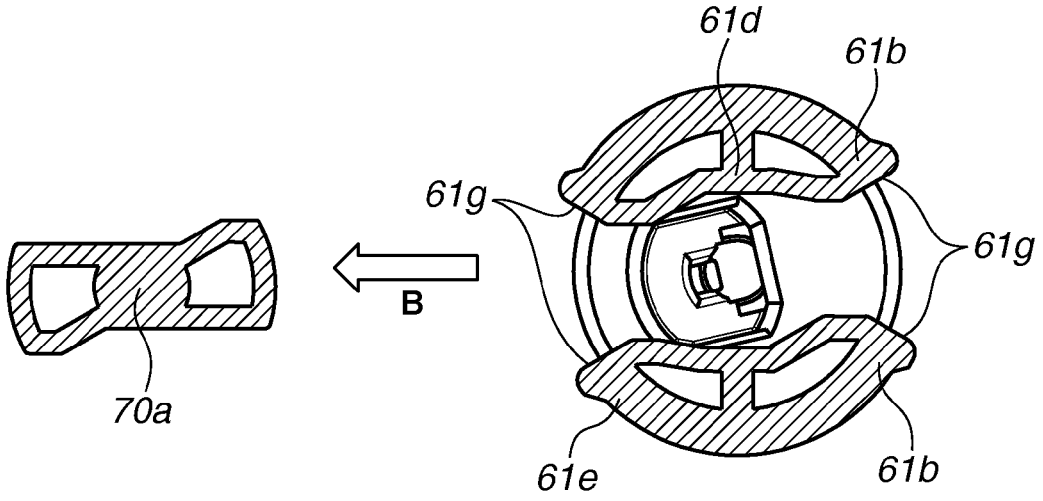
FIGS. 8A and 8B illustrate a process for engagement between the pressure release cam and the coupling.
Figure 8B:
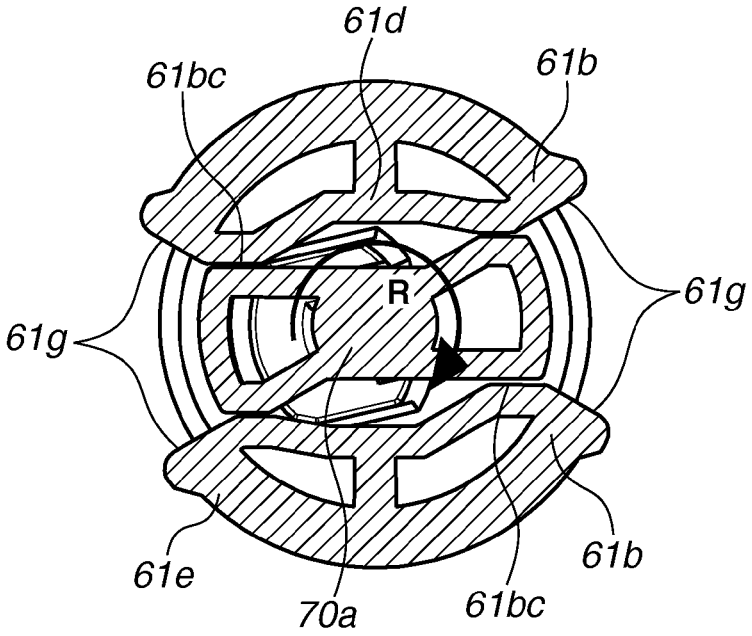

On the other hand, the main body of the image forming apparatus 1 includes a coupling 70 that engages with the pressure release cam 61A in the fixing unit 40 to transmit driving thereto (see FIG. 7). The coupling 70 rotates when driving is transmitted thereto from the motor M provided in the main body of the image forming apparatus 1. The motor M rotates in a forward direction so that the pressurizing roller 42 conveys the sheet S during fixing processing, and rotates in a backward direction when driving is transmitted to the pressure release cam 61A. A one-way clutch is provided in a power transmission path to the pressurizing roller 42 so that the pressurizing roller 42 does not rotate when the motor M rotates in a backward direction. The coupling 70 includes a coupling portion (second engagement portion) 70*a* that engages with the engagement portion 61*b* in the pressure release cam 61A and a gear portion 70*b* that rotates upon receiving a driving force from the motor M. When the coupling 70 rotates, power is transmitted to the pressure release cam 61A so that the pressure release cams 61A and 61B rotate together.

Figure 6A:
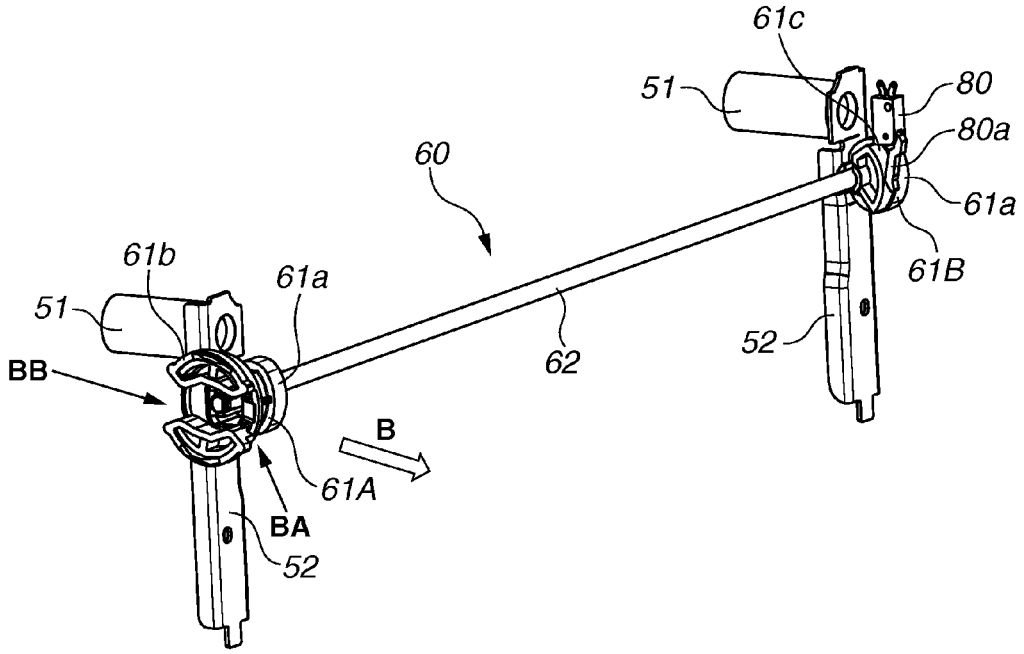
FIGS. 6A and 6B are perspective views respectively illustrating the pressure release unit in a pressurized state and a pressure released state.

When the image forming apparatus 1 is in a printing state or in a standby state, the area F of the cam portion 61*a* opposes the pressurizing plate 52. At this time, there is a gap between the cam portion 61*a* and the pressurizing plate 52, and the heating unit 41 pressurizes the pressurizing roller 42 with a force of the compression spring 51. Thus, the heating film 41*b* and the pressurizing roller 42 enter a pressurized state, and the fixing nip portion, which can perform fixing processing, is formed therebetween (FIG. 6A).

Figure 6B:
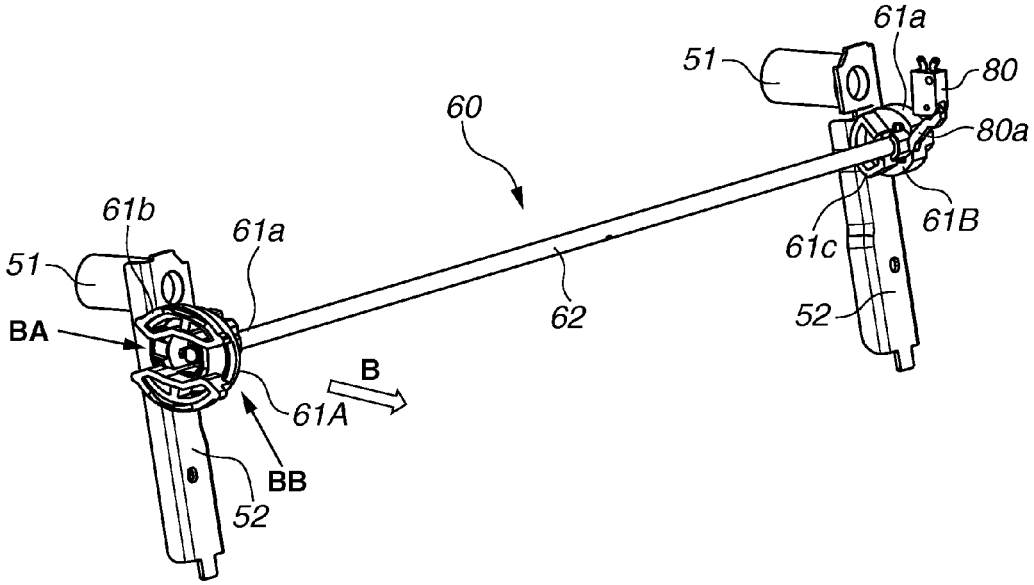

When a paper jam occurs in the image forming apparatus 1, or power to the image forming apparatus 1 is turned off, the pressure release cams 61A and 61B are driven via the coupling 70 to rotate, and the area E of the cam portion 61*a* comes closer to the pressurizing plate 52. Eventually, the pressurizing plate 52 is pushed in an opposite direction to a pressurization direction, to cause the pressurizing plate 52 to retreat. Consequently, application of pressure from the pressurizing plate 52 to the heating unit 41 decreases (or decreased to zero), the heating unit 41 does not press the pressurizing roller 42, and the fixing nip portion enters a pressure released state where its pressure is released (FIG. 6B).

Control of the phases of the pressure release cams 61A and 61B will be described below. The fixing unit 40 can set the pressurized state and the pressure released state, as described above. The pressure release sensor 80 detects respective positions where the pressure release cams 61A and 61B stop. The motor M is controlled based on a status (a print status, a jam status, a power OFF status, etc.) of the image forming apparatus 1 and an output of the pressure release sensor 80. The pressure release sensor 80 is arranged in the vicinity of the pressure release cam 61B on the opposite side of the pressure release cam 61A where the coupling 70 is arranged. More specifically, the fixing unit 40 is provided with a sensor action portion (detection portion) 61*c*, described below, for detecting the phases of the pressure release cams 61A and 61B. The sensor action portion 61*c* is provided at an end on the opposite side of an end, at which the engagement portion 61*b* is provided, of the rotation shaft 62 provided with the pressure release cams 61A and 61B. When the pressure release cam 61B rotates, the sensor action portion 61*c* provided in the cam 61B acts on a lever portion 80*a* in the pressure release sensor 80. The sensor action portion 61*c* has a cam shape, and its diameter changes in a circumference direction with respect to its rotation center, to change a pushing amount of the lever portion 80*a*.

When the sensor action portion 61*c* pushes the lever portion 80*a* in the pressure release sensor 80, the lever portion 80*a* rotates around its rotation center. When the lever portion 80*a* rotates, the pressure release sensor 80 is turned on. When the pushing amount of the lever portion 80*a* in the pressure release sensor 80 decreases, the pressure release sensor 80 is switched to an OFF state. A control unit detects a time period during which the pressure release cams 61A and 61B rotate from the timing at which ON and OFF states of the pressure release sensor 80 have been switched, and issues a stop instruction to the motor M after a predetermined time period elapsed until the pressure release cams 61A and 61B move to a pressurization position/pressure release position. The phases of the pressure release cams 61A and 61B are controlled, as described above.

The image forming apparatus 1 stops the motor M only when the pressure release cams 61A and 61B are at the pressurization position or the pressure release position. Therefore, the coupling 70 does not stop in a phase other than the pressurization position or the pressure release position.

Respective specific shapes of the pressure release cam 61A and the coupling 70 will be described below with reference to FIGS. 5A to 8B. In a direction of the rotation shaft 62, the engagement portion 61*b* is formed on an outer end surface of the pressure release cam 61A. The engagement portion 61*b* includes two protrusions 61*d* and 61*e* having shapes point-symmetrical with respect to a rotation center of the pressure release cam 61A. When the fixing unit 40 is mounted on the main body of the image forming apparatus 1, the coupling portion 70*a* in the coupling 70 provided in the main body of the image forming apparatus 1 engages with a groove portion 61*f* serving as a space sandwiched between the two protrusions 61*d* and 61*e*. There are provided two inlets BA and BB, which the coupling portion 70*a* in the coupling 70 enters, connecting with the groove portion 61*f*. There is a phase difference of 180° between the two inlets BA and BB. As illustrated in FIG. 6A, the coupling portion 70*a* can be received in the inlet BA when the fixing nip portion is in the pressurized state. As illustrated in FIG. 6B, the coupling portion 70*a* can be received in the inlet BB when the fixing nip portion is in the pressure released state. Thus, the coupling portion 70*a* can be received regardless of whether the fixing nip portion is in the pressurized state or the pressure released state. More specifically, the fixing unit 40 can be mounted on the main body of the image forming apparatus 1 regardless of whether the fixing nip portion is in the pressurized state or the pressure released state.

As illustrated in FIG. 7, the coupling 70 is provided with the coupling portion 70*a* having a protrusion shape. The coupling portion 70*a* is in a substantially rectangular parallelepiped protrusion shape, and is point-symmetrical with respect to a rotation center of the coupling 70. When the fixing unit 40 is mounted on the main body of the image forming apparatus 1 (FIGS. 8A and 8B), the groove portion 61*f* in the pressure release cam 61A engages with the coupling portion 70*a* in the coupling 70. A slope shape 61*g* for inviting the coupling portion 70*a* is provided in each of the inlets BA and BB in the groove portion 61*f*. When the coupling 70 rotates (in a direction indicted by an arrow R illustrated in FIG. 8B) by the engagement between the pressure release cam 61A and the coupling 70, the coupling portion 70*a* presses two sites 61*b* c of the engagement portion 61*b*, to transmit power thereto so that the pressure release cams 61A and 61B rotate.

The groove portion 61*f* in the pressure release cam 61A is substantially parallel to a direction in which the fixing unit 40 is mounted or removed, and opens regardless of whether the fixing unit 40 is in the pressurized state or the pressure released state. A phase of the coupling 70 provided in the main body of the image forming apparatus 1 is always in the pressurized state or the pressure released state. The coupling portion 70*a* is substantially parallel to the direction in which the fixing unit 40 is mounted or removed. Therefore, the phase of the pressure release cam 61A in the fixing unit 40, which has been removed from the main body of the image forming apparatus 1, can engage with the coupling 70 regardless of whether the phase of the pressure release cam 61A is in the pressurized state or the pressure released state.

Even if the respective phases of the coupling 70 and the pressure release cam 61A are shifted in the pressurized state or the pressure released state is a state where the fixing unit 40 is taken out of the main body of the image forming apparatus 1, the pressure release cam 61A can invite and engage with the coupling 70, if the phase shift may be within the range expected to occur, because the slope shape 61*g* is provided in each of the inlets BA and BB in the groove portion 61*f* in the pressure release cam 61A, even.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-215796, filed Oct. 22, 2014, which is hereby incorporated by reference herein in its entirety.

What is claimed is:

1. An image forming apparatus comprising:

a main body of the image forming apparatus;

a fixing unit configured to fix an unfixed image on a recording material to the recording material while conveying the recording material with the recording material nipped in a fixing nip portion, the fixing unit being removably mounted on the main body and including a cam for switching pressure applied to the fixing nip portion and a first engagement portion for transmitting a driving force to the cam; and a second engagement portion provided in the main body so as to engage with the first engagement portion in a state where the fixing unit is mounted on the main body, wherein the image forming apparatus can switch the fixing nip portion between a pressurized state and a pressure released state by rotating the cam via the first engagement portion and the second engagement portion, wherein a difference between a phase of the cam in the pressurized state and a phase of the cam in the pressure released state is 180°, wherein the first engagement portion has two inlets which the second engagement portion enters, and a difference between respective phases of the two inlets is 180°, and wherein the first engagement portion and the second engagement portion engage with each other when the fixing unit is mounted on the main body regardless of whether the fixing nip portion is in the pressurized state or the pressure released state.

2. The image forming apparatus according to claim 1, wherein the fixing unit includes a detection portion used for detecting the phase of the cam, and wherein the detection portion is provided at an end on the opposite side of an end, at which the first engagement portion is provided, of a shaft provided with the cam.

3. The image forming apparatus according to claim 1, wherein the first engagement portion is provided in the cam.

4. The image forming apparatus according to claim 1, wherein the first engagement portion includes two protrusions respectively having shapes point-symmetrical with respect to a rotation center of the cam.

5. The image forming apparatus according to claim 1, wherein the second engagement portion has a shape point-symmetrical with respect to its rotation center.

6. An image forming apparatus comprising:

a main body of the image forming apparatus;

a fixing unit configured to fix an unfixed image on a recording material to the recording material while conveying the recording material with the recording material nipped in a fixing nip portion, the fixing unit being removably mounted on the main body and including a cam for switching pressure applied to the fixing nip portion and a first engagement portion for transmitting a driving force to the cam; and a second engagement portion provided in the main body so as to engage with the first engagement portion in a state where the fixing unit is mounted on the main body, wherein the image forming apparatus can switch the fixing nip portion between a pressurized state and a pressure released state by rotating the cam via the first engagement portion and the second engagement portion, and wherein the first engagement portion includes two inlets which the second engagement portion enters, and a difference between phases of the two inlets is 180°.

7. The image forming apparatus according to claim 6, wherein the fixing unit includes a detection portion used for detecting a phase of the cam, and wherein the detection portion is provided at an end on the opposite side of an end, at which the first engagement portion is provided, of a shaft provided with the cam.

8. The image forming apparatus according to claim 6, wherein the first engagement portion is provided in the cam.

9. The image forming apparatus according to claim 6, wherein the first engagement portion includes two protrusions respectively having shapes point-symmetrical with respect to a rotation center of the cam.

10. The image forming apparatus according to claim 9, wherein the second engagement portion has a shape point-symmetrical with respect to its rotation center.

11. An image forming apparatus comprising:

a main body of the image forming apparatus;

a fixing unit configured to fix an unfixed image on a recording material to the recording material while conveying the recording material with the recording material nipped in a fixing nip portion, the fixing unit being removably mounted on the main body and including a cam for switching pressure applied to the fixing nip portion and a first engagement portion for transmitting a driving force to the cam; and a second engagement portion provided in the main body so as to engage with the first engagement portion in a state where the fixing unit is mounted on the main body, wherein the image forming apparatus can switch the fixing nip portion between a pressurized state and a pressure released state by rotating the cam via the first engagement portion and the second engagement portion, and wherein the first engagement portion has two inlets which the second engagement portion enters, and a difference between phases of the two inlets and a difference between a phase of the cam in the pressurized state and a phase of the cam in the pressure released state are the same.

12. The image forming apparatus according to claim 11, wherein the fixing unit includes a detection portion used for detecting the phase of the cam, and wherein the detection portion is provided at an end on the opposite side of an end, at which the first engagement portion is provided, of a shaft provided with the cam.

13. The image forming apparatus according to claim 11, wherein the first engagement portion is provided in the cam.

14. The image forming apparatus according to claim 11, wherein the first engagement portion includes two protrusions respectively having shapes point-symmetrical with respect to a rotation center of the cam.

15. The image forming apparatus according to claim 14, wherein the second engagement portion has a shape point-symmetrical with respect to its rotation center.

* * * * *